US011713576B2

(12) United States Patent
Hsieh

(10) Patent No.: US 11,713,576 B2
(45) Date of Patent: Aug. 1, 2023

(54) THREE-DIMENSIONAL LIGHTWEIGHT STEEL FRAMING SYSTEM FORMED BY BI-DIRECTIONAL CONTINUOUS DOUBLE BEAMS

(71) Applicant: Ying Chun Hsieh, Fengyuan (TW)

(72) Inventor: Ying Chun Hsieh, Fengyuan (TW)

( * ) Notice: Subject to any disclaimer, the term of this patent is extended or adjusted under 35 U.S.C. 154(b) by 4 days.

(21) Appl. No.: 17/148,023

(22) Filed: Jan. 13, 2021

(65) Prior Publication Data

US 2021/0131104 A1 May 6, 2021

Related U.S. Application Data

(63) Continuation-in-part of application No. 15/037,584, filed as application No. PCT/CN2015/071574 on Jan. 26, 2015, now abandoned.

(30) Foreign Application Priority Data

Jan. 24, 2014 (CN) ..... 201410035766.3

(51) Int. Cl.
*E04C 5/065* (2006.01)
*E04B 1/24* (2006.01)
*E04B 5/40* (2006.01)

(52) U.S. Cl.
CPC ..... *E04C 5/065* (2013.01); *E04B 1/2403* (2013.01); *E04B 5/40* (2013.01); *E04B 2001/2466* (2013.01)

(58) Field of Classification Search
CPC ..... E04B 1/24; E04B 2001/2457; E04B 5/29; E04C 3/40; E04C 3/293; E04C 3/294; E04C 2003/0404
See application file for complete search history.

(56) References Cited

U.S. PATENT DOCUMENTS 523,425 A * 12/1908 Cornell
2,082,960 A * 6/1937 Kinninger ..... E04C 5/16 52/649.3

(Continued)

FOREIGN PATENT DOCUMENTS

CN 201502135 6/2010
CN 103114668 5/2013

(Continued)

*Primary Examiner* — Brian E Glessner
*Assistant Examiner* — Daniel J Kenny
(74) *Attorney, Agent, or Firm* — McHale & Slavin, P.A.

(57) ABSTRACT

The present invention discloses a three-dimensional lightweight steel framing system formed by bi-directional continuous double beams. The three-dimensional lightweight steel framing system comprises beams, purlins, columns, wall bodies, floor slabs and lateral resistant mechanism comprises of diagonal support or bracing, wherein the beams are continuous double beams, and the continuous double beams are formed by combination of identical or different continuous single beams, and the continuous single beams are respectively arranged at the both sides of the columns, and the single beams are kept continuous at the junctions with the columns. The three-dimensional lightweight steel framing system simplifies the production of the lightweight steel member, and simplifies the on-site assembly by using bolts and nuts.

4 Claims, 13 Drawing Sheets

(56) References Cited

U.S. PATENT DOCUMENTS

| | | | | |
|---|---|---|---|---|
| 2,775,019 | A * | 12/1956 | Bemis | E04B 5/268 249/176 |
| 3,600,868 | A | 8/1971 | Wilson, Jr. et al. | |
| 3,989,226 | A | 11/1976 | Burgess | |
| 4,342,177 | A | 8/1982 | Smith | |
| 5,289,665 | A | 3/1994 | Higgins | |
| 5,941,035 | A | 8/1999 | Purse | |
| 7,140,155 | B1 * | 11/2006 | Nasimov | E04B 1/24 52/236.8 |
| 7,143,554 | B2 | 12/2006 | Sachs et al. | |
| 7,299,596 | B2 | 11/2007 | Hildreth | |
| 7,624,550 | B2 | 12/2009 | Ospina | |
| 7,642,550 | B2 | 1/2010 | Taylor | |
| 7,677,009 | B2 * | 3/2010 | Bowman | E04C 3/09 52/645 |
| 7,779,590 | B2 | 8/2010 | Hsu et al. | |
| 8,056,291 | B1 | 11/2011 | diGirolamo et al. | |
| 8,091,316 | B2 | 1/2012 | Beck et al. | |
| 8,234,827 | B1 * | 8/2012 | Schroeder, Sr. | E04B 1/24 52/638 |
| 8,281,534 | B2 | 10/2012 | Bae et al. | |
| 8,528,294 | B2 | 9/2013 | Vanker et al. | |
| 8,820,012 | B2 | 9/2014 | Hsieh | |
| 8,915,042 | B2 | 12/2014 | Ahn et al. | |
| 8,973,333 | B2 | 3/2015 | Sugihara et al. | |
| 9,151,036 | B2 | 10/2015 | Hsieh | |
| 9,512,616 | B2 | 12/2016 | Rahimzadeh et al. | |
| 9,803,364 | B2 * | 10/2017 | Hsieh | E04C 3/08 |
| 2008/0040997 | A1 | 2/2008 | Klein | |
| 2010/0218443 | A1 * | 9/2010 | Studebaker | E04B 1/22 52/698 |

FOREIGN PATENT DOCUMENTS

| | | |
|---|---|---|
| CN | 203296170 | 11/2013 |
| CN | 103711230 | 4/2014 |
| CN | 103790231 | 5/2014 |
| TW | 377446 | 12/1999 |

* cited by examiner

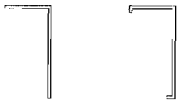
Fig. 2-1A
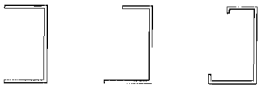
Fig. 2-1B
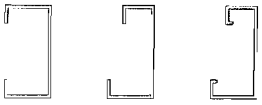
Fig. 2-1C
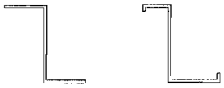
Fig. 2-1D
Fig. 2-1E
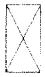
Fig. 2-1F
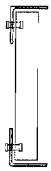
Fig. 2-1G
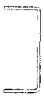
Fig. 2-2A
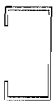
Fig. 2-2B
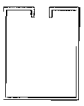
Fig. 2-2C
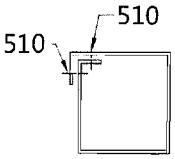
Fig. 2-2D
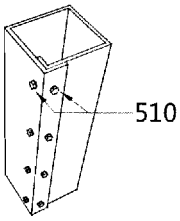
Fig. 2-2E
Fig. 2-3A
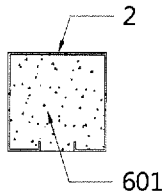
Fig. 2-3B
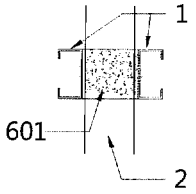
Fig. 2-3C
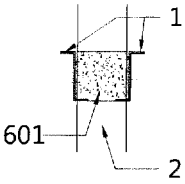
Fig. 2-3D
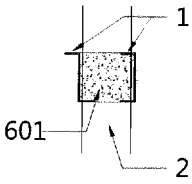
Fig. 2-3E
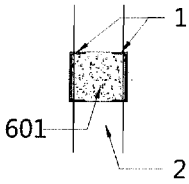
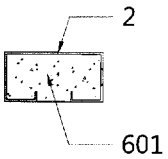
Fig. 2-3F
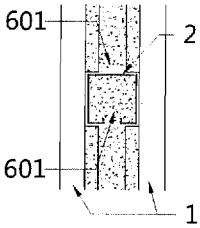
Fig. 2-3G
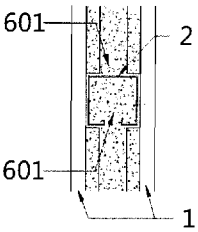
Fig. 2-3H
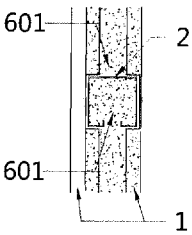
Fig. 2-3I
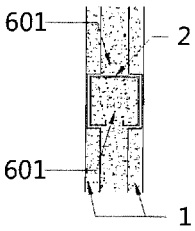
Fig. 2-3J

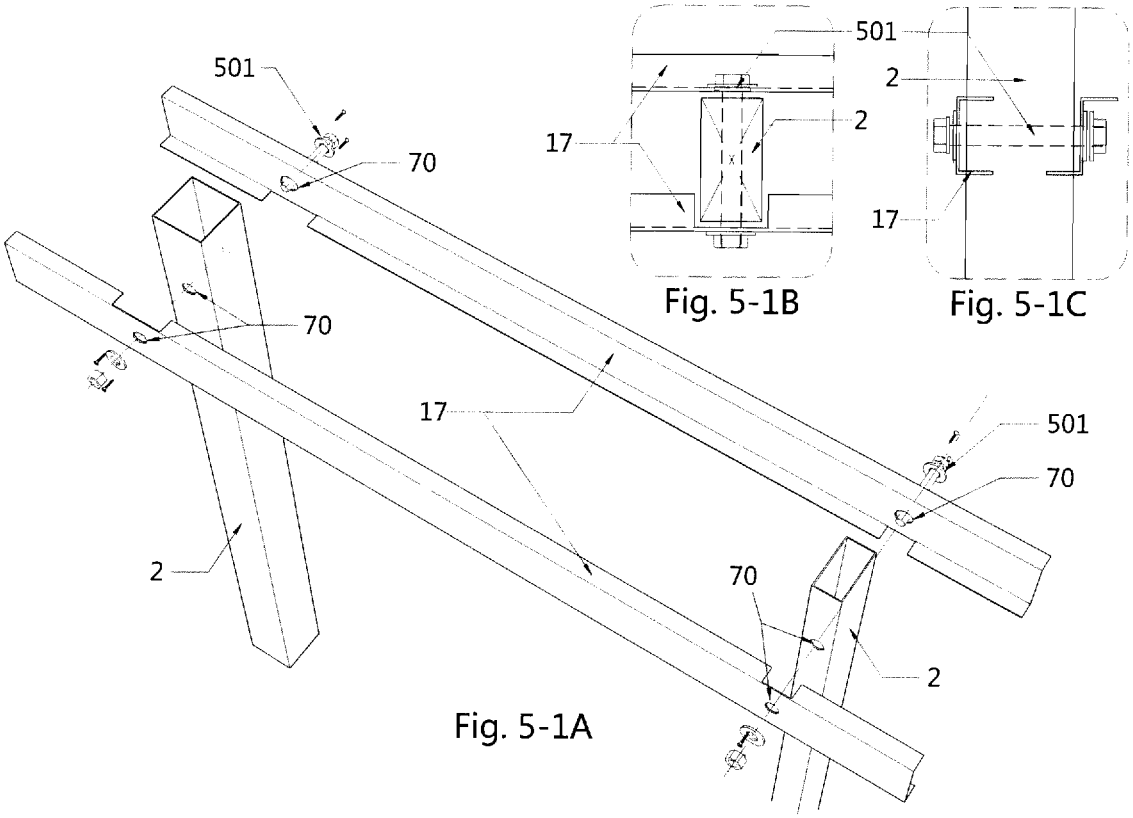
Fig. 5-1A
Fig. 5-1B
Fig. 5-1C
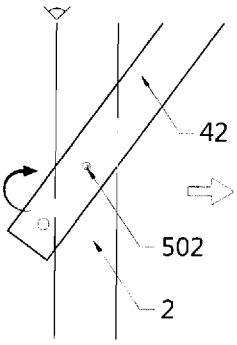
Fig. 5-2A
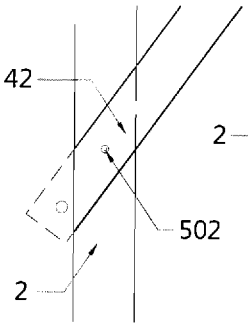
Fig. 5-2B
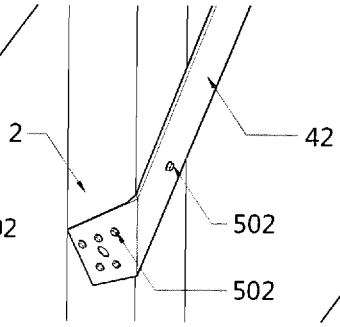
Fig. 5-2C
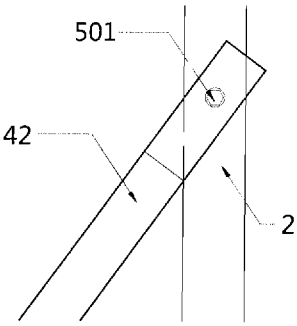
Fig. 5-2D
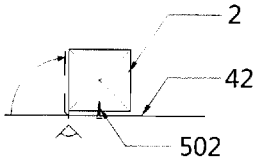
Fig. 5-2E
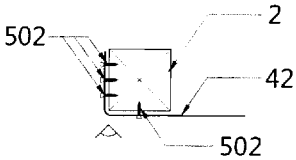
Fig. 5-2F
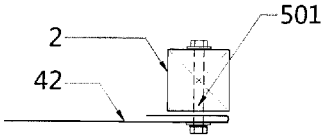
Fig. 5-2G

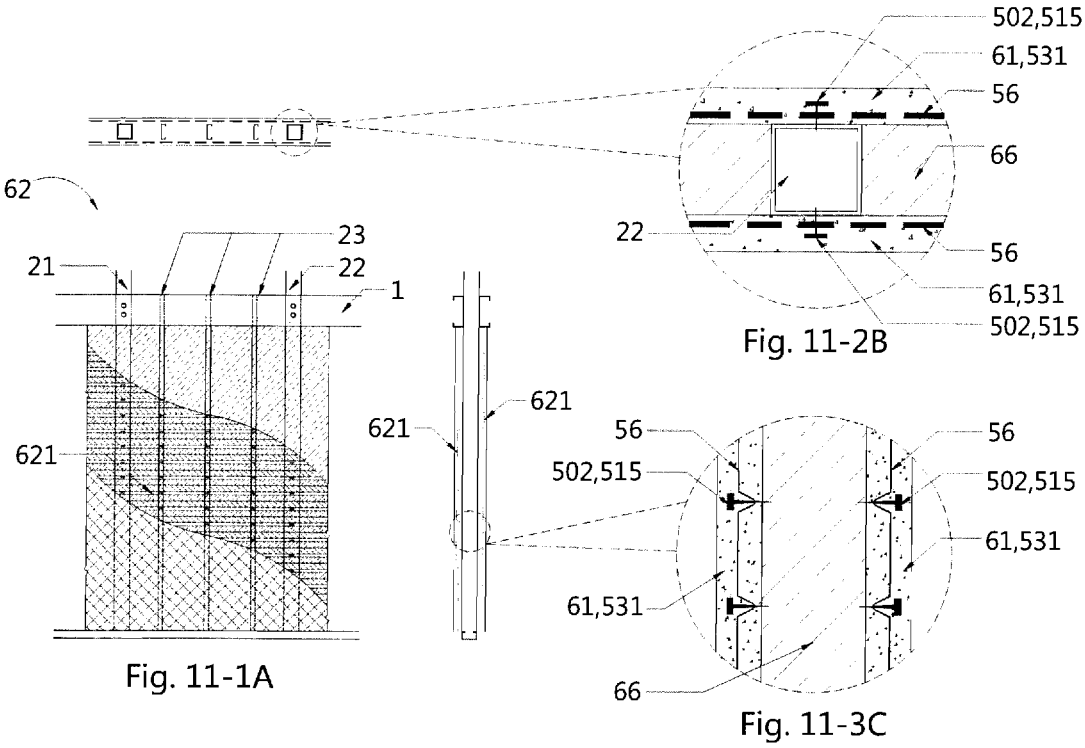
Fig. 11-2B
Fig. 11-1A
Fig. 11-3C
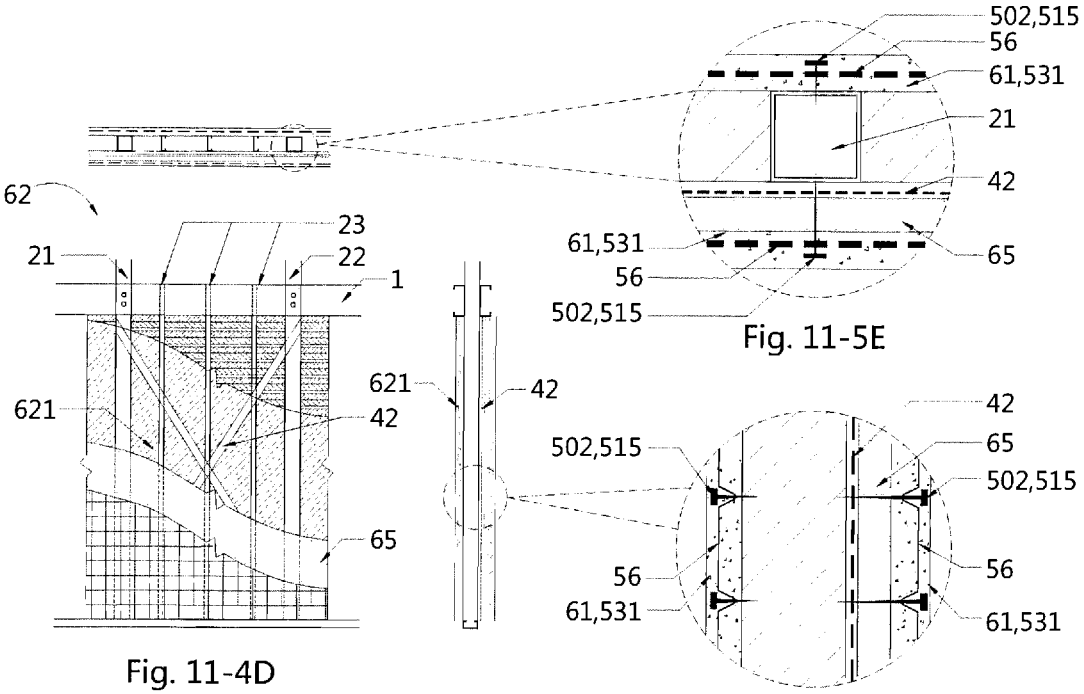
Fig. 11-5E
Fig. 11-4D
Fig. 11-6F

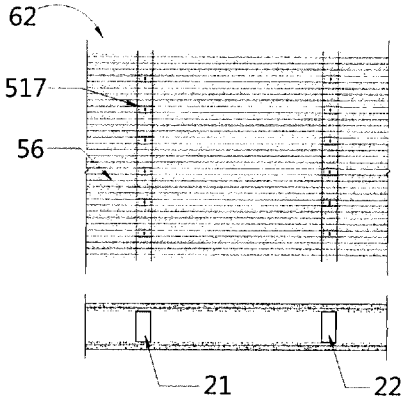
Fig. 12-1A
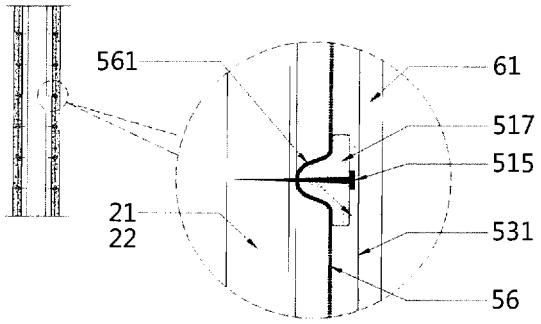
Fig. 12-2B
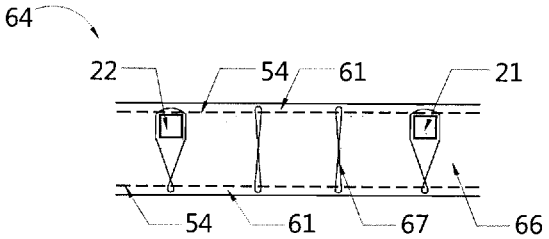
Fig. 13-1A
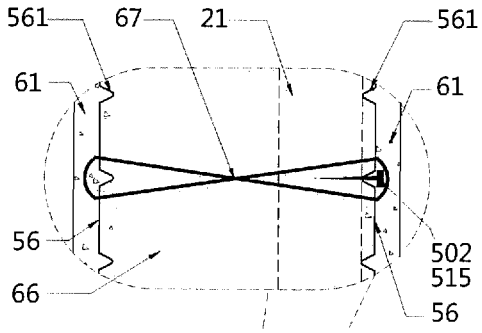
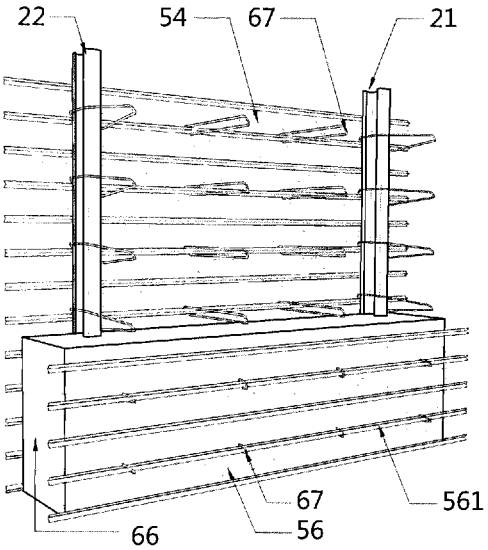
Fig. 13-2B
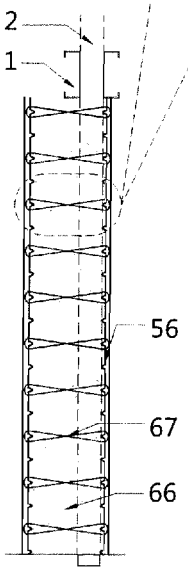
Fig. 13-3C

THREE-DIMENSIONAL LIGHTWEIGHT STEEL FRAMING SYSTEM FORMED BY BI-DIRECTIONAL CONTINUOUS DOUBLE BEAMS

PRIORITY CLAIM

In accordance with 37 C.F.R. 1.76, a claim of priority is included in an Application Data Sheet filed concurrently herewith. Accordingly, the present invention is a continuation-in-part of U.S. patent application Ser. No. 15/037,584 entitled "THREE-DIMENSIONAL LIGHTWEIGHT STEEL TRUSS WITH BI-DIRECTIONAL CONTINUOUS DOUBLE BEAMS", filed May 18, 2016, which is a 35 U.S.C. § 371 U.S. National stage application of PCT/CN2015/071574, filed Jan. 26, 2015 entitled "THREE-DIMENSIONAL LIGHTWEIGHT STEEL FRAMEWORK FORMED BY TWO-WAY CONTINUOUS DOUBLE BEAMS", which claims priority to Chinese Patent Application No. 201410035766.3, filed Jan. 24, 2014, the contents of which are incorporated herein by reference.

BACKGROUND OF THE INVENTION

Field of the Invention

The present invention relates to a lightweight steel framing system, and more particularly, to a three-dimensional lightweight steel framing system.

Description of the Prior Art

The use of lightweight steel framing system has been developed rapidly and widely applied to industrial buildings. In recent years, residential occupancy has become a new field of application and also a new growth point for the lightweight steel framing system. At present, despite the fact that the cost of lightweight steel framing system is generally higher than concrete structure, lightweight steel framing system still has competitive advantages of fast construction, energy saving and carbon emission reduction, etc. More and more construction institutions have recognized the superiority of the lightweight steel framing, which has gradually become the preferred structural system for industrial buildings and has been widely used in low-rise civil residential buildings.

The application of lightweight steel framing system still has a lot of drawbacks to be improved in terms of architectural design, structure design, production and installation technology. At present, the structural beams and columns of the lightweight steel framing are generally connected by means of butt joint (e.g., in a fixed or hinged manner). Such connection complicated an assembly process of the lightweight framing structure and results serious accumulative errors during assembly.

In China Patent Application No. 200920171128.9 filed on Aug. 20, 2009, which has a corresponding U.S. Pat. No. 9,803,364 filed by the same applicant, it provides a lightweight steel framing system with structural beams and structural columns. Each structural beam consists of a pair of continuous beams. The structural column is located between the two continuous beams. However, it fails to disclose a floor slab, a roof, a reinforced lightweight composite floor slab, and a lateral resistant bracing. Therefore, an overall structural strength of the lightweight steel framing system is insufficient. Furthermore, a cross section of a continuous double beam of the lightweight steel framing system cannot be changed according to different situation, which is not flexible and wastes material. Moreover, the continuous double beams are connected to each other by a crisscross joint. Such connection results in extra space consumption and ununiformed load distribution. Furthermore, it is difficult to connect the long continuous double beams with such connection.

Inmost of the lightweight steel framing systems, a column or a diagonal support or brace is usually secured onto an anchor bolt secured to the foundation. The anchor blot is positioned and embedded on site, which complicates the assembling process. In China Patent Application No. 200920158989.3 filed on Jun. 30, 2009, which has a corresponding U.S. Pat. No. 8,820,012 filed by the same applicant, it provides an integral positioning steel frame to overcome the aforementioned drawbacks. However, a fastener for securing the anchor blot cannot maintain an upright posture and is prone to be loose because the fastener is fixed onto only one point on a bottom of the integral positioning steel frame. Furthermore, it takes much time to cure concrete before securing the anchor bolt and assembling the lightweight steel framing system, which extends construction period.

Generally, square section steel component commonly used in the field is formed by an enclosed square section steel tube. In practical applications, a connection hole on the enclosed square section steel tube is formed by drilling or flame cutting instead of punching, which increases manufacturing cost. Furthermore, a high strength fastener cannot be used for connecting the enclosed square section steel tube, which reduces the connection strength. Moreover, in order to prevent from rusting, the enclosed square steel tube is required to be galvanized after machining, which also increases manufacturing cost. If the square section is formed by two cold-rolled C-shaped steel members welded to each other, the galvanized coating may be damaged. In China Patent Application No. 201010216616.4 filed on Jun. 30, 2010, which has a corresponding U.S. Pat. No. 9,151,036 filed by the same applicant, it overcomes the aforementioned drawbacks. However, in practical application, the compressive strength of the square-shaped steel tube filled with concrete/cement mortar in the patent is far greater than the bearing capability calculated by the slenderness ratio of the square-shaped column in the patent. In other words, the reinforcement of concrete/cement mortar has no function until it reaches the compressive yield strength of the concrete/cement mortar, in which the square-shaped column is already damaged. Furthermore, the square-shaped steel tube with concrete/cement mortar cannot be arranged closely during transportation, which results in excessive transportation volume and high transportation cost.

In China Patent Application No. 201310044986.8 filed on Feb. 4, 2013, in order to reduce a weight of a floor slab and improve performance of waterproof and fireproof of the floor slab, it reduces a thickness of the floor slab for reducing the weight of the floor slab. However, a lateral force resistance of the floor slab is reduced at the same time, which reduces a capability of the floor slab for transferring a horizontal force.

In China Patent Application No. 200920147815.7 filed on Apr. 14, 2009, and China Patent Application No. 201310664792.8 filed on Dec. 10, 2013, an expanded ribbed mesh cannot be engaged with the web firmly, so that a diaphragm effect is reduced.

In China Patent Application No. 201110023291.2 filed on Jan. 20, 2011, a positioning and supporting member cannot position a steel mesh and a wall body firmly, which allows a painted layer to be easily cracked along a longitudinal direction of the positioning and supporting member.

Therefore, there is a need to design a three-dimensional lightweight steel framing system to overcome the above drawbacks.

SUMMARY OF THE INVENTION

A main objective of the present invention is to provide a three-dimensional lightweight steel framing system with enhanced structural strength, so that a heavy material, such as a brick, concrete, or soil, can be adapted for the three-dimensional lightweight steel framing system.

Another objective of the present invention is to provide a three-dimensional lightweight steel framing system with simple structure which meets the safety and environmental standards and facilitates the in-situ operation.

According to the claimed invention, a three-dimensional lightweight steel framing system includes a beam, a column, a wall body, a purlin, a floor slab, and a lateral resistant mechanism comprises of a diagonal support or a bracing. The beam is a continuous double beam includes two identical or different continuous single beams attached at both sides of the column. The continuous single beam and the column are kept continuous at the junction with the column.

According to an embodiment of the present invention, the column includes a structural major column, a minor column, a wall reinforcing column, a diagonal support, a vertical member of truss beam and a diagonal member of truss beam. The beam includes a horizontal beam, a slanted roof beam, an upper chord of truss beam, a bottom chord of truss beam, and a ground tie beam. The continuous single beam is formed by at least one of a L-shaped steel member, a U-shaped steel member, a C-shaped steel member, a Z-shaped steel member, a plate-shaped steel member, and a slice truss. The purlin is formed by at least one of the U-shaped steel member, the C-shaped steel member, the Z-shaped steel member, and the slice truss. The slice truss includes an upper chord, a bottom chord, and a lateral resistant diagonal support. The upper chord and the bottom chord is formed by the L-shaped steel member, and the lateral resistant diagonal support is formed by the L-shaped steel member, the plate-shaped steel member, or a steel tube. The column is formed by at least one of a U-shaped steel member, a C-shaped steel member, an open square-shaped steel member, a bent square-shaped steel member, and a square-shaped steel member. The cavity of the open square-shaped steel member can be further reinforced by infilling with the concrete or the cement mortar. The bent square-shaped steel member is formed by cold rolling the steel plate into square forming two 90-degree lips on both ends, and the lips at both ends are overlapped and fastened with rivets at proper distances respectively. The continuous single beam is connected to the column by means of a bolt passing through a connection hole on the web of the continuous single beam and a connection hole on the column and fixing with nuts.

According to an embodiment of the present invention, the L-shaped steel member, the U-shaped steel member, the C-shaped steel member, the Z-shaped steel member and the open square-shaped steel member are provided with curled lips. An upper flange and a bottom flange of the U-shaped steel member, an upper flange and a bottom flange of the C-shaped steel member, or an upper flange and a bottom flange of the Z-shaped steel member have an identical width or different widths. The L-shaped steel member, the U-shaped steel member, the C-shaped steel member, the Z-shaped steel member, the open square-shaped steel member, the bent square-shaped steel member, and the plate-shaped steel member are preferably formed by cold rolling from galvanized steel reel.

According to an embodiment of the present invention, the continuous single beam comprises a plurality of single beams connected via at least one overlapped connection or at least one beam connector.

According to an embodiment of the present invention, the floor slab can further adopt in part or completely a reinforced lightweight composite floor slab. The reinforced lightweight composite floor slab comprises a lightweight composite floor slab, a purlin, a lateral resistant bracing and/or a cemented steel mesh ceiling. The lightweight composite floor slab is installed over the purlin. The lateral resistant bracing and/or a cemented steel mesh ceiling are built under the purlin.

According to an embodiment of the present invention, the lightweight composite floor slab comprises a floor deck formed by a profiled steel sheet connected to the purlin by the floor connector and is filled with concrete or cement mortar. The profiled steel sheet is a corrugated profiled steel sheet or a folded profiled steel sheet. The profiled steel sheet is with a 0.2 to 1.0 millimeter thickness and a 30 to 50 millimeter groove depth. The concrete or the cement mortar can further installed with an internal anti-cracking mesh or anti-cracking fiber. The depth of concrete or cement mortar is less than 50 millimeter from the top of concrete or cement mortar to the top of the profiled steel sheet. The floor connector comprises a self-tapping screw, a sleeve and/or a bearing gasket. The sleeve is tightly attached to the self-tapping screw. The sleeve is made of metal or plastic. At least one side of the sleeve is expanded to form the bearing gasket. The purlin is disposed at intervals of less than 180 centimeter. At least one pair of opposite corners of the lightweight composite floor slab are bounded by the lateral resistant bracing. The lateral resistant bracing is formed by a strip steel. The strip steel is connected to the purlin by the self-tapping screw. The cemented steel mesh ceiling is connected to the purlin by the self-tapping screw and/or an air nail. The cemented steel mesh ceiling comprises a first expanded ribbed steel mesh covered with cement mortar. The cement mortar is further reinforced with an anti-cracking mesh and/or an anti-cracking fiber.

According to an embodiment of the present invention, the continuous single beam is an embedded continuous single beam. An upper flange and a bottom flange of the embedded continuous single beam are cut off corresponding to the edge of the column. The embedded continuous single beam is connected to the column by means of the bolts passing through the connection hole on the web of the continuous single beam and the connection hole on the column and fixing with nuts. The embedded continuous single beam is formed by the L-shaped steel member, the C-shaped steel member or the Z-shaped steel member.

According to an embodiment of the present invention, the three-dimensional lightweight steel framing system further comprises at least one reinforced mechanism.

According to an embodiment of the present invention, the bottom chord of truss beam is formed by the open square-shaped steel member with an upward opening. A part of the open square-shaped steel member overlapping the column or the diagonal member of truss beam is cut off. The open square-shaped steel member is connected to the column or the diagonal member of truss beam by means of the bolts passing through the connection hole and fixing with nuts, so as to form the reinforced mechanism.

According to an embodiment of the present invention, a space between two continuous single beams, and/or a cavity within the columns, and/or a cavity within the open square-shaped steel member of the bottom chord of truss beam is filled with the concrete and/or the cement mortar, so as to form the reinforced mechanism.

According to an embodiment of the present invention, the reinforced mechanism is a plurality of self-tapping screw disposed at a periphery of the bolt and for temporarily fixing the beam and the column after the entire frame is calibrated, and the plurality of self-tapping screw is removed after the space between the two continuous single beams, and/or the cavity within the columns, and/or the cavity within the open square-shaped steel member of the bottom chord of truss beam is filled with the concrete and/or the cement mortar.

According to an embodiment of the present invention, a steel component is arranged in the space between the two continuous single beams, and/or in the cavity within the columns or the open square-shaped steel member of the bottom chord of truss beam, where the concrete and/or the cement mortar is filled, so as to form the reinforced mechanism. The steel component is a steel rebar, a stirrup, or a pre-stressed steel cable.

According to an embodiment of the present invention, the stirrup is a square stirrup, a cylindric stirrup, a helical stirrup or a cylindric steel mesh. The pre-stressed steel cable is further provided with an anchor.

According to an embodiment of the present invention, the reinforced mechanism is an additional steel plate attached to the connection hole of the beam of the column. The additional steel plate is fastened to the beam of the column by means of a rivet, and/or a clinching joint, and/or by welding.

According to an embodiment of the present invention, the reinforced mechanism is a punching groove forming on the connection hole of the beam. The punching groove is embedded into the enlarged connection hole of the column, and a diameter of the enlarged connection hole of the column is greater than the diameter of the punching groove.

According to an embodiment of the present invention, the reinforced mechanism is an additional component attached on an outer side of the beam. The additional component is formed by the L-shaped steel member, the U-shaped steel member, the C-shaped steel member, the plate-shaped steel member, the square-shaped steel member, or a square-shaped wooden member.

According to an embodiment of the present invention, a thermal insulating gasket is arranged between the beam and the additional component.

According to an embodiment of the present invention, the column is wrapped around by a steel mesh, a woven steel mesh, or an expanded steel mesh and connected to the masonry wall by a cement mortar layer, so as to form the reinforced mechanism.

According to an embodiment of the present invention, the reinforced mechanism is an integrally-positioned steel frame. The integrally-positioned steel frame comprises an angle connector, a positioning plate for bolt, a frame body, an embedded bolt, an embedded bolt. The embedded bolt is connected to a base of the column via the angle connector. The frame body is preferably formed by the C-shaped steel member with an upward opening and with a positing hole. The positioning plate for bolt is arranged above the positioning hole of the frame body. The frame body is embedded in the foundation after the embedded bolt is fixed, and the base of the column is arranged above the integrally-positioned steel frame, and an anti-pulling nut can be further placed below the positioning plate for bolt and/or the frame body.

According to an embodiment of the present invention, the reinforced mechanism is a reinforcing column at the outer periphery of the structural major column. The reinforcing column comprises steel columns and/or reinforced concrete columns surrounding the structural main column. The steel columns and/or the reinforced concrete columns are continuous or interrupted at the junction of the beam and the structural major column, and a cavity between the steel columns and the structural major column are filled with the concrete or the cement mortar.

According to an embodiment of the present invention, the reinforced mechanism is a precast concrete wall slab and/or a precast lightweight concrete wall slab and/or a precast hollow concrete wall slab installed between the two continuous single beams.

According to an embodiment of the present invention, the reinforced mechanism is a composite wall with diaphragm effect installed between the columns. The composite wall with diaphragm effect comprises a wall infill, a wall surface with diaphragm effect. The wall surface with diaphragm effect comprises a second expanded ribbed steel mesh, a cement mortar layer, and a fastener. The wall surface with diaphragm effect is attached to at least one side of the column, when the wall surface with diaphragm effect is attached on only one side of the column, the lateral resistant bracing is arranged at the other side of the column.

According to an embodiment of the present invention, the second expanded ribbed steel mesh comprises a V-shaped rib and an expanded mesh surface. The second expanded ribbed steel mesh is fixed onto the column by means of the self-tapping screw or the air nail, and the lateral resistant bracing is formed by a strip steel.

According to an embodiment of the present invention, the composite wall with diaphragm effect further comprises a reinforcing member. The reinforcing member comprises a fixation gasket and an anti-cracking component. The fixation gasket is tightly attached to a groove of the V-shaped rib for seating the air nail. The fixation gasket is preferably made of hard plastic, and the anti-cracking component is a fiberglass mesh or a spot-welded metal mesh, or fiber in the cement mortar layer.

According to an embodiment of the present invention, the reinforced mechanism is an expanded ribbed mesh binding wall body installed between the columns. The expanded ribbed mesh binding wall body encloses the structural major column, the minor column and/or the wall reinforcing column, and the diagonal support. The expanded ribbed mesh binding wall body comprises a wall infill, two second expanded ribbed steel meshes, and a tying member. One of the two second expanded ribbed steel meshes is fastened onto one side of the structural major column, the minor column and the wall reinforcing column by means of the self-tapping screw or the air nail. The wall infill is disposed between the two second expanded ribbed steel meshes. The second expanded ribbed steel mesh comprises a V-shaped rib and an expanded mesh surface. The tying member is a steel wire or plastic wire. The tying member ties the two second expanded ribbed steel meshes to each other by pulling the V-shaped rib of the second expanded ribbed steel mesh, and the wall infill is recycled building waste, soil, grass, concrete or lightweight concrete.

In summary, the three-dimensional lightweight steel framing system has advantages of simple structure and low manufacturing cost. The three-dimensional lightweight steel framing system can be secured by bolts and nuts, which allows non-professional workers to participate in the construction process. The column is sandwiched between the two single beams, so that the column and the beam can be assembled simultaneously, which is flexible in replacement and assembly. The steel member is preferably formed by cold rolling from galvanized steel reel, which facilitates automated production. During the production and the in-situ assembly, no welding process is required, so it prevents the galvanized layer from being damaged. The reinforced strength of the three-dimensional lightweight steel framing system makes the traditional wet wall made of heavy materials, such as bricks, concretes, soils, and recycled materials, be used cooperatively. Furthermore, by disposing two continuous single beams on both sides of the column, it reduces accumulative error during assembly.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 2-1A is a sectional diagram of L-shaped steel member according to the present invention.

FIG. 2-1B is a sectional diagram of U-shaped steel member according to the present invention.

FIG. 2-1C is a sectional diagram of C-shaped steel member according to the present invention.

FIG. 2-1D is a sectional diagram of Z-shaped steel member according to the present invention.

FIG. 2-1E is a sectional diagram of plate-shaped steel member according to the present invention.

FIG. 2-1F is a sectional diagram of square-shaped wooden member according to the present invention.

FIG. 2-1G is a sectional diagram of slice truss according to the present invention.

FIG. 2-2A is a sectional diagram of U-shaped steel member according to the present invention.

FIG. 2-2B is a sectional diagram of C-shaped steel member according to the present invention.

FIG. 2-2C is a sectional diagram of open square-shaped steel member according to the present invention.

FIG. 2-2D is a sectional diagram of bent square-shaped steel member according to the present invention.

FIG. 2-2E is a axonometric diagram of bent square-shaped steel member according to the present invention.

FIG. 2-3A is a sectional diagram of column reinforced by infilling with concrete or cement mortar according to the present invention.

FIG. 2-3B is a diagram of the front view of two continuous single beams according to the present invention.

FIG. 2-3C is a diagram of the front view of two continuous single beams according to the present invention.

FIG. 2-3D is a diagram of the front view of two continuous single beams according to the present invention.

FIG. 2-3E is a diagram of the front view of two continuous single beams according to the present invention.

FIG. 2-3F is a sectional diagram of column reinforced by infilling with concrete or cement mortar according to the present invention.

FIG. 2-3G is a diagram of the top view of two continuous single beams according to the present invention.

FIG. 2-3H is a diagram of the top view of two continuous single beams according to the present invention.

FIG. 2-3I is a diagram of the top view of two continuous single beams according to the present invention.

FIG. 2-3J is a diagram of the top view of two continuous single beams according to the present invention.

FIG. 3-1A is a diagram of the top view of single beams connected via the overlapped connection according to the present invention.

FIG. 3-1B is a diagram of the top view of single beams connected via the overlapped connection according to the present invention.

FIG. 3-1C is a diagram of the front view of single beams connected via the overlapped connection according to the present invention.

FIG. 3-1D is a diagram of the front view of single beams connected via the overlapped connection according to the present invention.

FIG. 3-1E is a diagram of single beams connected via the overlapped connection according to the present invention.

FIG. 3-2A is a diagram of the top view of slice truss connected via the overlapped connection according to the present invention.

FIG. 3-2B is a diagram of the front view of slice truss connected via the overlapped connection according to the present invention.

FIG. 3-2C is a sectional diagram of slice truss connected via the overlapped connection according to the present invention.

FIG. 3-3A is a diagram of the top view of single beams connected via a beam connector according to the present invention.

FIG. 3-3B is a diagram of the front view of single beams connected via a beam connector according to the present invention.

FIG. 3-3C is a sectional diagram of single beams connected via a beam connector according to the present invention.

FIG. 3-3D is a sectional diagram of single beams connected via a beam connector according to the present invention.

FIG. 3-3E is a diagram of single beams connected via abeam connector according to the present invention.

FIG. 4-1A is a diagram of the reinforced lightweight composite floor slab according to the present invention.

FIG. 4-2A is a sectional diagram of the lightweight composite floor slab according to the present invention.

FIG. 4-3A is a diagram of the self-tapping screw and sleeve and bearing gasket according to the present invention.

FIG. 4-3B is a diagram of the self-tapping screw and sleeve and bearing gasket according to the present invention.

FIG. 4-3C is a diagram of the top view of the self-tapping screw and sleeve and bearing gasket according to the present invention.

FIG. 4-4A is a sectional diagram of the profiled steel sheet according to the present invention.

FIG. 4-5A is a sectional diagram of the profiled steel sheet according to the present invention.

FIG. 4-6A is a diagram of the first expanded ribbed steel mesh according to the present invention.

FIG. 4-7A is a sectional diagram of the first expanded ribbed steel mesh according to the present invention.

FIG. 4-8A is a sectional diagram of the reinforced lightweight composite floor slab according to the present invention.

FIG. 4-9A is a sectional diagram of the reinforced lightweight composite floor slab according to the present invention.

FIG. 5-1A is a diagram of the embedded continuous single beam according to the present invention.

FIG. 5-1B is a sectional diagram of the embedded continuous single beam according to the present invention.

FIG. 5-1C is a sectional diagram of the embedded continuous single beam according to the present invention.

FIG. 5-2A is a diagram of the lateral resistant bracing according to the present invention.

FIG. 5-2B is a diagram of the lateral resistant bracing according to the present invention.

FIG. 5-2C is a diagram of the lateral resistant bracing according to the present invention.

FIG. 5-2D is a diagram of the lateral resistant bracing according to the present invention.

FIG. 5-2E is a diagram of the lateral resistant bracing according to the present invention.

FIG. 5-2F is a diagram of the lateral resistant bracing according to the present invention.

FIG. 5-2G is a diagram of the lateral resistant bracing according to the present invention.

FIG. 6-1A is a diagram of the slice truss according to the present invention.

FIG. 6-2B is a diagram of the top view of the slice truss according to the present invention.

FIG. 6-3C is a sectional diagram of the slice truss along a A-A' line shown in FIG. 6-1A according to the present invention.

FIG. 6-4D is a sectional diagram of the slice truss along a B-B' line shown in FIG. 6-1A according to the present invention.

FIG. 6-5E is a diagram of the slice truss according to the present invention.

FIG. 7-1A is a diagram of the truss beam according to the present invention.

FIG. 7-2A is a diagram of the front view of the truss beam according to the present invention.

FIG. 7-3A is a sectional diagram of the truss beam along a C-C' line shown in FIG. 7-2A according to the present invention.

FIG. 7-4A is a sectional diagram of the space between the two continuous single beams according to the present invention.

FIG. 7-4B is a sectional diagram of the space between the two continuous single beams according to the present invention.

FIG. 7-4C is a sectional diagram of the space between the two continuous single beams according to the present invention.

FIG. 8-1A is a diagram of the front view of the punching grove and the additional steel plate according to the present invention.

FIG. 8-2A is a sectional diagram of the punching groove according to the present invention.

FIG. 8-3A is a schematic diagram of the punching groove according to the present invention.

FIG. 8-4A is a sectional diagram of the additional steel plate according to the present invention.

FIG. 8-4B is a sectional diagram of the additional steel plate according to the present invention.

FIG. 8-4C is a sectional diagram of the additional steel plate according to the present invention.

FIG. 8-4D is a sectional diagram of the additional steel plate according to the present invention.

FIG. 8-4E is a sectional diagram of the additional steel plate according to the present invention.

FIG. 8-4F is a sectional diagram of the additional steel plate according to the present invention.

FIG. 8-5A is a sectional diagram of the additional steel plate along a F-F' line shown in FIG. 8-4A to FIG. 8-4E according to the present invention.

FIG. 8-5B is a sectional diagram of the additional steel plate along a F-F' line shown in FIG. 8-4F according to the present invention.

FIG. 9-1A is a schematic diagram of the reinforced mechanism according to the present invention.

FIG. 9-2B is a sectional diagram of the reinforced mechanism along a G-G' line shown in FIG. 9-1A according to the present invention.

FIG. 9-3C is a sectional diagram of the reinforced mechanism along a H-H' line shown in FIG. 9-1A according to the present invention.

FIG. 9-4D is a sectional diagram of the reinforced mechanism along a I-I' line shown in FIG. 9-1A according to the present invention.

FIG. 9-5E is a sectional diagram of the reinforced mechanism along a J-J' line shown in FIG. 9-1A according to the present invention.

FIG. 9-6F is a sectional diagram of the reinforced Mechanism along a K-K' line shown in FIG. 9-1A according to the present invention.

FIG. 10-1A is a diagram of the front view of the integrally-positioned steel frame according to the present invention.

FIG. 10-2B is a schematic diagram of the integrally-positioned steel frame according to the present invention.

FIG. 10-3C is a sectional diagram of the frame body according to the present invention.

FIG. 10-4D is a diagram of the positioning plate for bolt according to the present invention.

FIG. 10-5E is a sectional diagram of the integrally-positioned steel frame according to the present invention.

FIG. 11-1A is a diagram of the composite wall with diaphragm effect according to the present invention.

FIG. 11-2B is a sectional diagram of the composite wall with diaphragm effect according to the present invention.

FIG. 11-3C is a sectional diagram of the composite wall with diaphragm effect according to the present invention.

FIG. 11-4D is a diagram of the composite wall with diaphragm effect according to the present invention.

FIG. 11-5E is a sectional diagram of the composite wall with diaphragm effect according to the present invention.

FIG. 11-6F is a sectional diagram of the composite wall with diaphragm effect according to the present invention.

FIG. 12-1A is a diagram of the composite wall with diaphragm effect according to the present invention.

FIG. 12-2B is a sectional diagram of the composite wall with diaphragm effect according to the present invention.

FIG. 13-1A is a sectional diagram of the expanded ribbed mesh binding wall body according to the present invention.

FIG. 13-2B is a diagram of the expanded ribbed mesh binding wall body according to the present invention.

FIG. 13-3C is a sectional diagram of the expanded ribbed mesh binding wall body according to the present invention.

FIG. 14-1A is a diagram of the reinforcing column according to the present invention.

FIG. 14-2B is a diagram of the reinforcing column according to the present invention.

FIG. 14-3C is a diagram of the reinforcing column according to the present invention.

DETAILED DESCRIPTION

In order to make the objects, the technical solutions and the advantages of the present invention more apparent, the present invention will be described hereinafter in conjunction with the drawings and embodiments.

Figure 1:
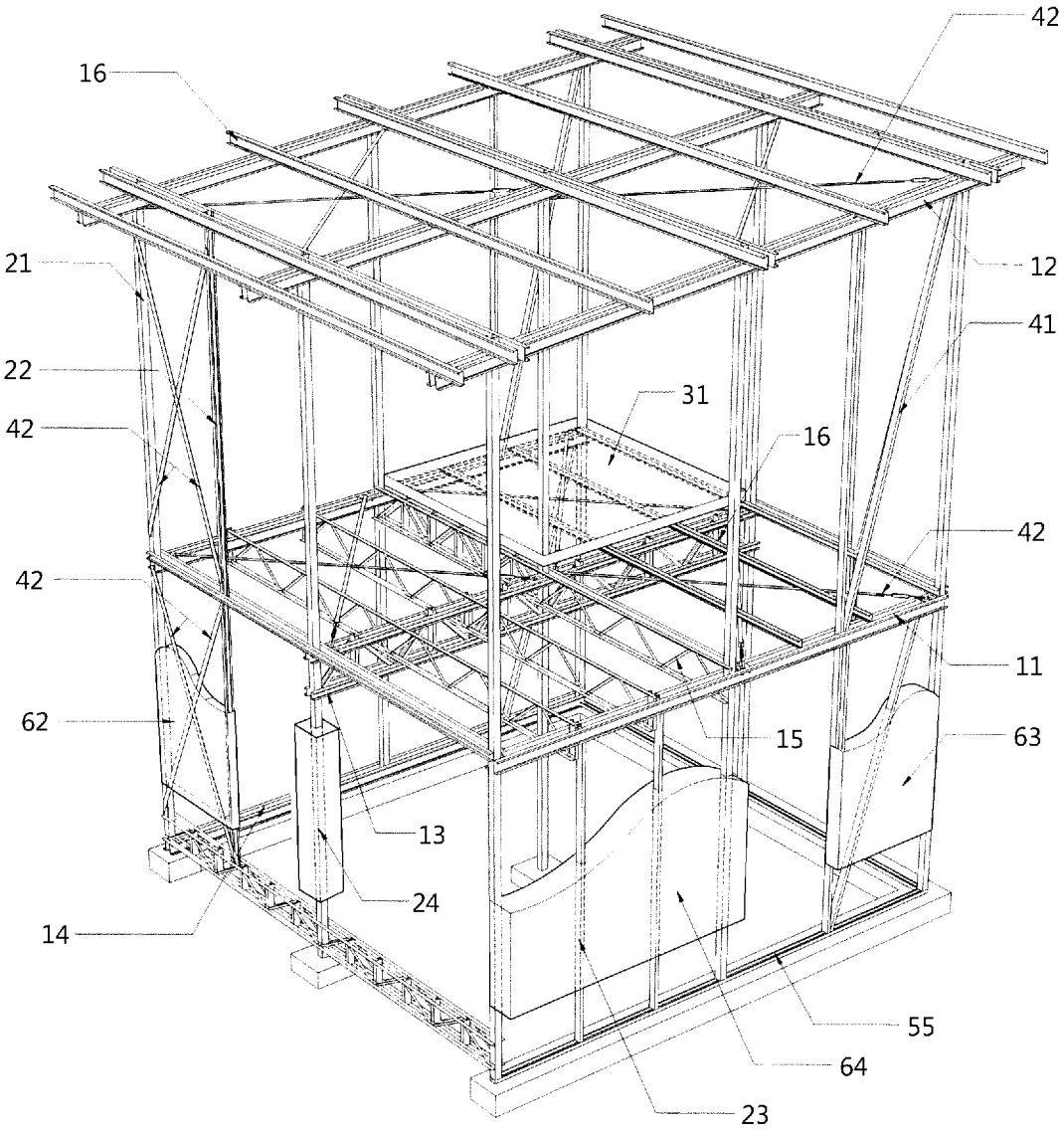
FIG. 1 is a diagram of a three-dimensional lightweight steel framing system according to the present invention.

Please refer to FIG. 1. FIG. 1 is a diagram of a three-dimensional lightweight steel framing system according to the present invention. The three-dimensional lightweight steel framing system includes a horizontal beam 11, a slanted roof beam 12, a ground tie beam 14, a slice truss 15, a truss beam 13, a purlin 16, an integrally-positioned steel frame 55, a structural major column 21, a minor column 22, a wall reinforcing column 23, a reinforcing column 24 at the outer periphery of the structural major column 21, a diagonal support 41, a lateral resistant bracing 42, a composite wall with diaphragm effect 62, a masonry wall 63, an expanded ribbed mesh binding wall body 64, and a reinforced lightweight composite floor slab 31. Each of the horizontal beam 11, the slanted roof beam 12, and the ground tie beam 14 is a continuous double beam including two continuous single beams 1. Each of the structural major column 21, the minor column 22, and the wall reinforcing column 23 is a column 2. The wall reinforcing column 23 is disposed in the composite wall with diaphragm effect 62, a masonry wall 63 or the expanded ribbed mesh binding wall body 64.

Figures 1A, 3:
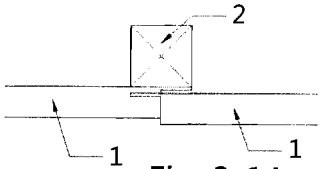
Figures 1B, 3:
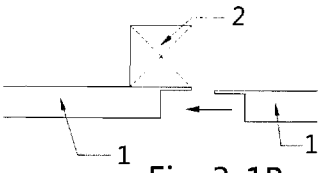
Figures 1E, 3:
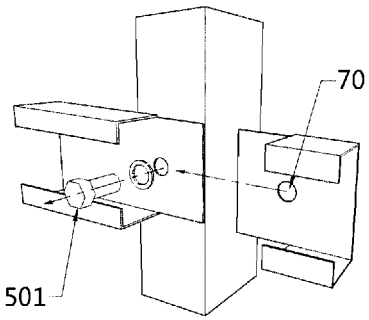
Figures 1C, 3:
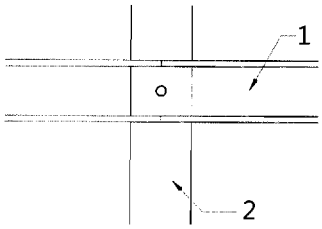
Figures 1D, 3:
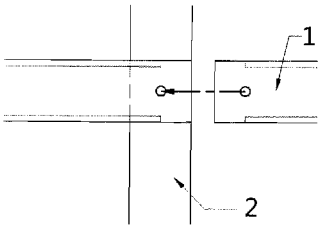

Please refer to FIG. 2-1A to FIG. 2-1G, which are the sectional diagrams of the continuous single beam 1 according to the present invention. As shown in FIG. 2-1A, the beam 1 can be formed by a L-shaped steel member. As shown in FIG. 2-1B, the beam 1 can be formed by an U-shaped steel member. As shown in FIG. 2-1C, the beam 1 can be formed by a C-shaped steel member. As shown in FIG. 2-1D, the beam 1 can be formed by a Z-shaped steel member. As shown in FIG. 2-1E, the beam 1 can be formed by a plate-shaped steel member. As shown in FIG. 2-1F, an additional component attached on an outer side of the beam 1 can be formed by a square-shaped wooden member. As shown in FIG. 2-1G, the beam 1 can be formed by a slice truss. Furthermore, the L-shaped steel member (FIG. 2-1A), the U-shaped steel member (FIG. 2-1B, FIG. 2-2A), the C-shaped steel member (FIG. 2-1C, FIG. 2-2B), the Z-shaped steel member (FIG. 2-1D) and the open square-shaped steel member (FIG. 2-2C) are provided with curled lips. An upper flange and a bottom flange of the U-shaped steel member (FIG. 2-1B), an upper flange and a bottom flange of the C-shaped steel member (FIG. 2-1C), or an upper flange and a bottom flange of the Z-shaped steel member (FIG. 2-1D) have an identical width or different widths.

Figures 2A, 3:
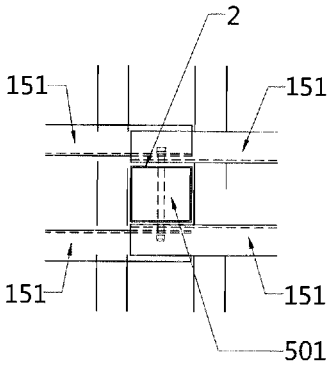

Please refer to FIG. 2-2A to FIG. 2-2E, which are the sectional diagrams of the column 2 according to the present invention. As shown in FIG. 2-2A, the column 2 can be formed by an U-shaped steel member. As shown in FIG. 2-2B, the column 2 can be formed by a C-shaped steel member. As shown in FIG. 2-2C, the column 2 can be formed by an open square-shaped steel member. As shown in FIG. 2-2D and FIG. 2-2E, the column 2 can be formed by a bent square-shaped steel member. The bent square-shaped steel member (FIG. 2-2D, 2-2E) is formed by cold rolling the steel plate into square forming two 90-degree lips on both ends, and the lips at both ends are overlapped and fastened with rivets 510 at proper distances respectively.

Please refer to FIG. 2-3A to FIG. 2-3J, which are the reinforced mechanism formed by filling the space between two continuous single beam 1, and/or a cavity within the column 2 with a concrete and/or a cement mortar 601 according to the present invention.

Please refer to FIG. 3-1A to FIG. 3-1E, which are diagrams of single beams 1 connected to column 2 via the overlapped connection according to the present invention.

Figures 2B, 3:
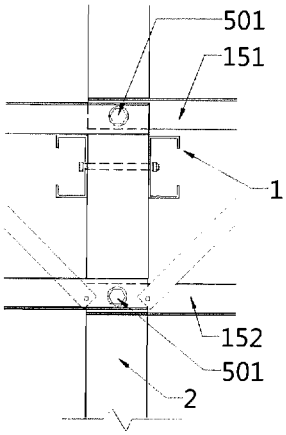
Figures 2C, 3:
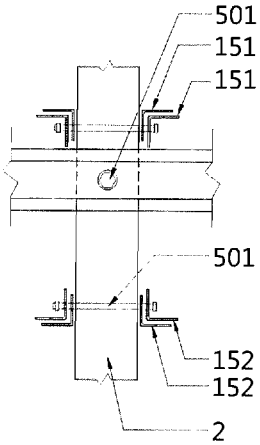

Please refer to FIG. 3-2A to FIG. 3-2C, which are diagrams of slice truss comprises an upper chord 151, a bottom chord 152 connected to column 2 via the overlapped connection according to the present invention.

Figures 3, 3A:
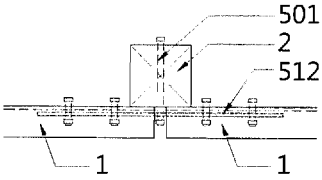
Figures 3, 3E:
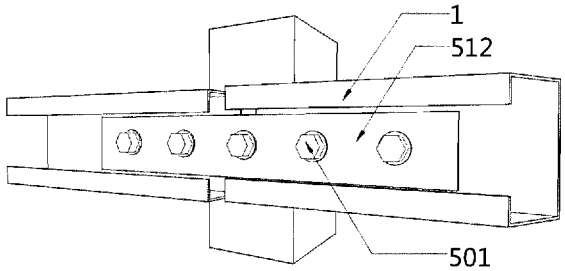
Figures 3, 3B:
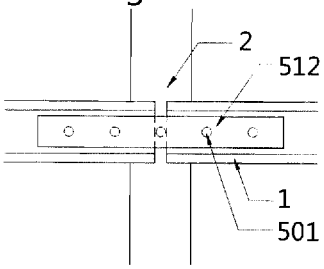
Figures 3, 3C:
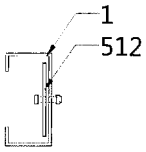
Figures 3, 3D:
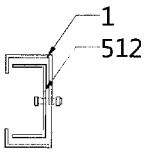

Please refer to FIG. 3-3A to FIG. 3-3D, which are diagrams of single beams 1 connected via a beam connector 512 according to the present invention.

Figures 1A, 4:
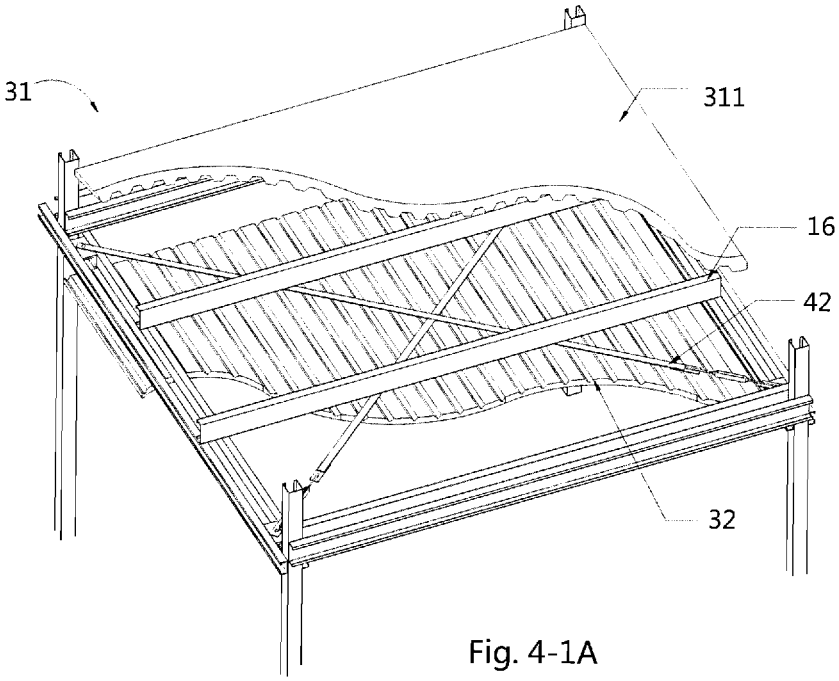
Figures 2A, 4:
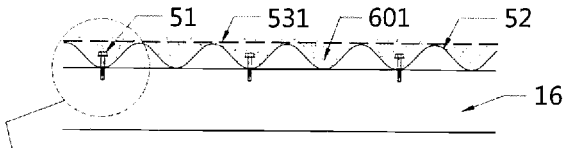

Please refer to FIG. 4-1A to FIG. 4-9A, which are diagrams of the reinforced lightweight composite floor slab according to the present invention. As shown in FIG. 4-1A, the reinforced lightweight composite floor slab 31 comprises a lightweight composite floor slab 311, a purlin 16, a lateral resistant bracing 42 and/or a cemented steel mesh ceiling 32. The lightweight composite floor slab 311 is installed over the purlin 16. The lateral resistant bracing 42 and/or the cemented steel mesh ceiling 32 are built under the purlin 16. As shown in FIG. 4-2A, the lightweight composite floor slab 311 comprises a floor deck formed by a profiled steel sheet 52 connected to the purlin 16 by the floor connector 51 and is filled with concrete or cement mortar 601. The concrete or the cement mortar 601 can further installed with anti-cracking mesh or anti-cracking fiber 531. As shown in FIG. 4-3A, FIG. 4-3B, and FIG. 4-3C, the floor connector 51 comprises a self-tapping screw 502, a sleeve 513 and/or a bearing gasket 514. The sleeve 513 is tightly attached to the self-tapping screw 502. The sleeve 513 is made of metal or plastic. At least one side of the sleeve 513 is expanded to form the bearing gasket 514. As shown in FIG. 4-4A and FIG. 4-5A, the profiled steel sheet 52 is a corrugated profiled steel sheet or a folded profiled steel sheet. As shown in FIG. 4-6A and FIG. 4-7A, the cemented steel mesh ceiling 32 comprises a first expanded ribbed steel mesh 54 with a first V-shaped rib 541. As shown in FIG. 4-8A, at least one pair of opposite corners of the lightweight composite floor slab 311 are bounded by the lateral resistant bracing 42. As shown in FIG. 4-9A, a cemented steel mesh ceiling 32 is connected to the purlin 16 by the self-tapping screw 502 and/or the air nail 515. The cemented steel mesh ceiling comprises a first expanded ribbed steel mesh 54 covered with cement mortar layer 61, and the cement mortar layer 61 is further reinforced with an anti-cracking mesh and/or an anti-cracking fiber 531.

Figures 4, 5, 6, 6A:
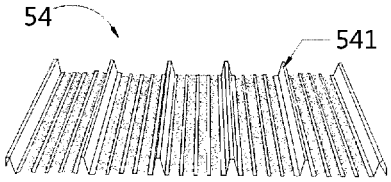
Figures 3A, 4:
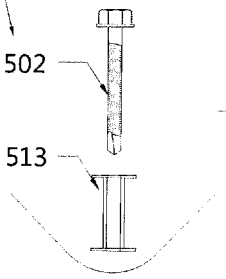
Figures 3B, 4:
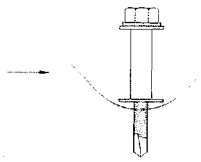
Figures 3C, 4:
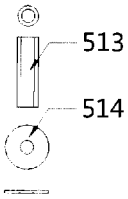

Please refer to FIG. 5-1A to FIG. 5-1C, which are diagrams of the embedded continuous single beam according to the present invention. As shown in FIG. 5-1A, an upper flange and bottom flange of the continuous single beam 1 is cut off corresponding to the edge of the column 2. The embedded continuous single beam 17 is connected to the column 2 by means of the bolts 501 passing through the connection hole 70 on the web of the continuous single beam 1 and the connection hole 70 on the column 2 and fixing with nuts. As shown in FIG. 5-1B and FIG. 5-1C, the embedded continuous single beam 17 is formed by the C-shaped steel member and the Z-shaped steel member.

Please refer to FIG. 5-2A to FIG. 5-2G, which are diagrams of the lateral resistant bracing according to the present invention.

Figures 1A, 6:
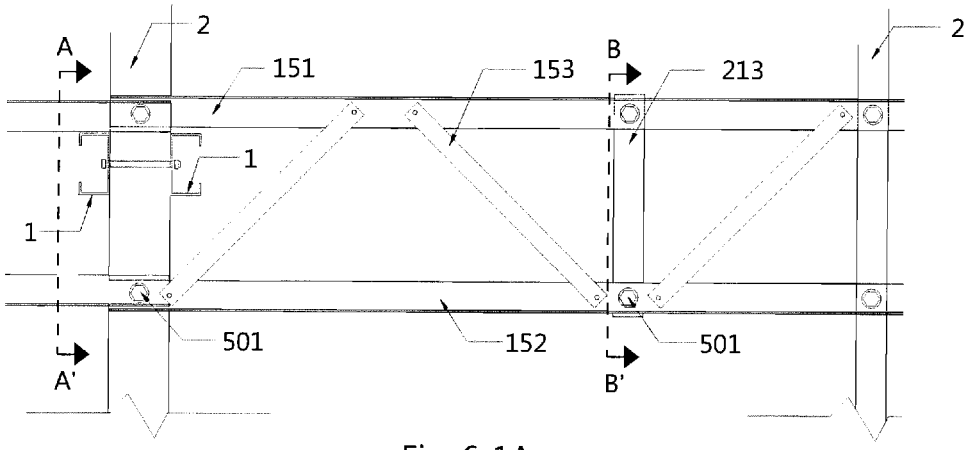
Figures 2B, 6:
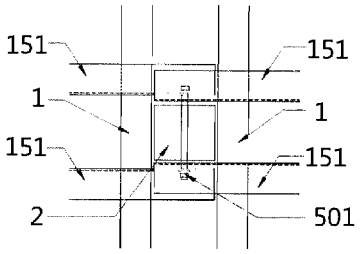
Figures 3C, 6:
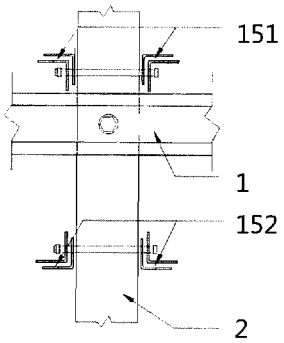
Figures 4D, 6:
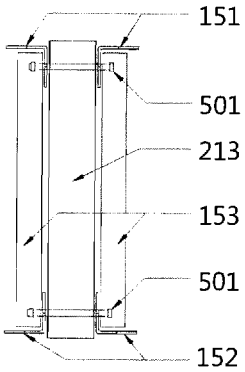
Figures 5E, 6:
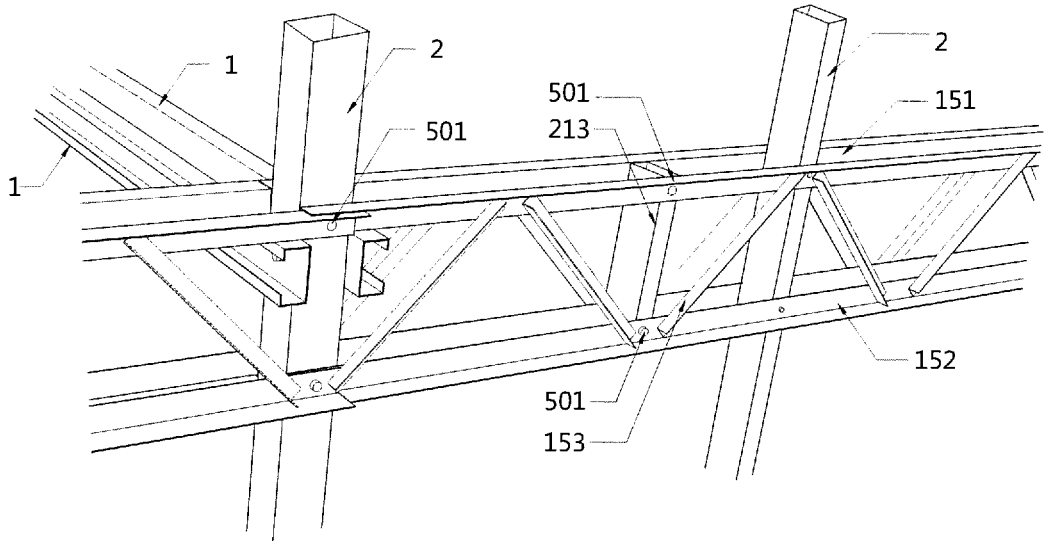

Please refer to FIG. 6-1A to FIG. 6-5E, which are diagrams of the slice truss according to the present invention.

As shown in FIG. 6-1A, the slice truss comprises an upper chord 151, a bottom chord 152, a lateral resistant diagonal support 153, and a vertical member of truss beam 213. The upper chord 151 and the bottom chord 152 is formed by the L-shaped steel member. The lateral resistant diagonal support 153 is formed by the L-shaped steel member, the plate-shaped steel member or a steel tube. As shown in FIG. 6-2B, the upper chord 151 is connected to the column 2 via the overlapped connection. As shown in FIG. 6-3C, which is a sectional diagram of the slice truss along a A-A' line shown in FIG. 6-1A. As shown in FIG. 6-4D, which is a sectional diagram of the slice truss along a B-B' line shown in FIG. 6-1A. As shown in FIG. 6-5E, which is a diagram of the slice truss according to the present invention.

Figures 4, 5, 6, 7, 7A:
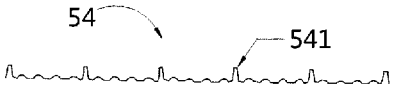

Please refer to FIG. 7-1A to FIG. 7-3A, which are diagrams of the truss beam 13 comprises of an upper chord of truss beam 131, a bottom chord of truss beam 132, a vertical member of truss beam 213 and a diagonal member of truss beam according to the present invention. As shown in FIG. 7-1A and FIG. 7-2A, the upper chord of truss beam 131 and the bottom chord of truss beam 132 are connected to the column 2 by means of a bolt 501. As shown in FIG. 7-3A, which is a sectional diagram of the truss beam 13 along a C-C' line shown in FIG. 7-2A, the bottom chord of truss beam 132 is formed by the open square-shaped steel member with an upward opening and a part of the open square-shaped steel member overlapping the column 2 or the diagonal member of truss beam 134 is cut off. The open square-shaped member is connected to the column 2 or the diagonal member of truss beam 134 by means of the bolts 501 passing through the connection hole 70 and fixing with nuts, so as to form the at least one reinforced mechanism. The cavity within the open square-shaped steel member of the bottom chord of truss beam 132 is filled with the concrete and/or the cement mortar 601, so as to form the at least one reinforced mechanism.

Figures 4, 4A:
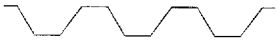
Figures 4, 5, 5A:
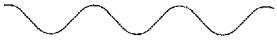
Figures 1A, 7:
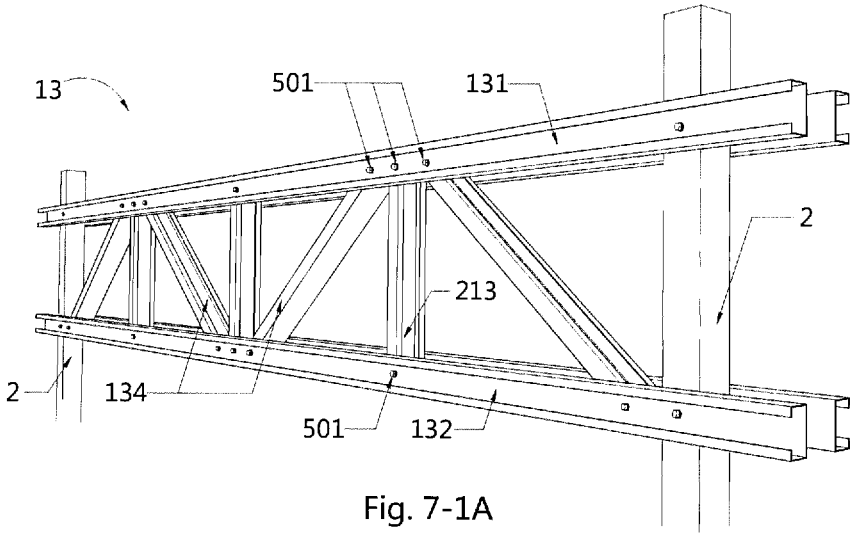
Figures 2A, 7:
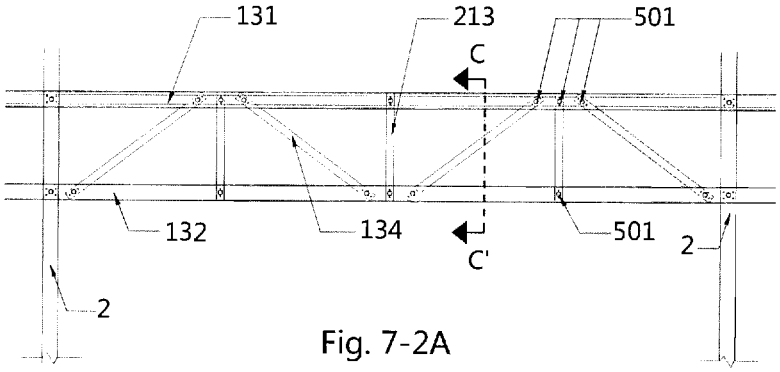
Figures 3A, 7:
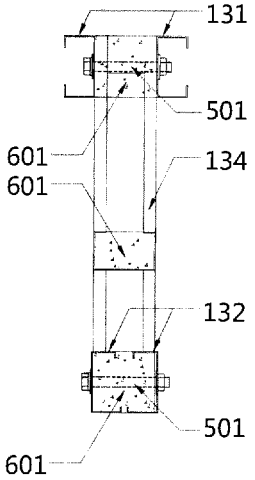
Figures 4A, 7:
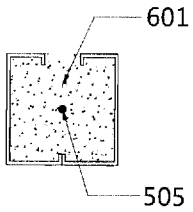
Figures 4B, 7:
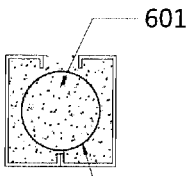
Figures 4C, 7:
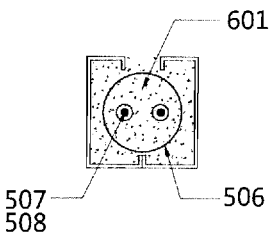

Please refer to FIG. 7-4A to FIG. 7-4C, which are sectional diagrams of a steel component arranged in the space between the two continuous single beam 1 where the concrete and/or the cement mortar 601 is filled, so as to form the at least one reinforced mechanism. The steel component is a steel rebar 505, a stirrup 506, or a pre-stressed steel cable 507. The stirrup 506 is a square stirrup, a cylindric stirrup, a helical stirrup or a cylindric steel mesh. The pre-stressed steel cable 507 is further provided with an anchor 508.

Figures 4, 5, 6, 7, 8, 8A:
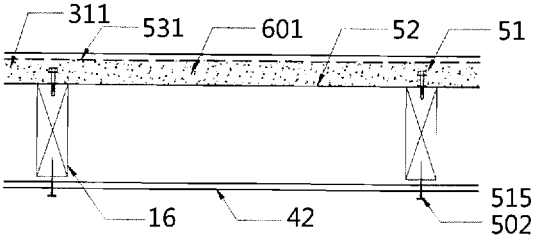
Figures 1A, 8:
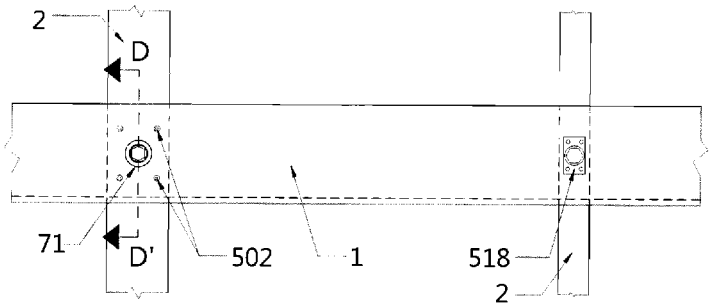
Figures 2A, 8:
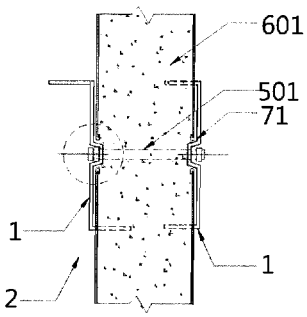
Figures 3A, 8:
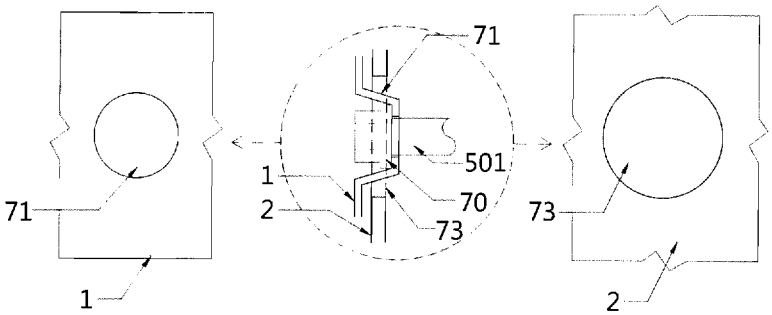
Figures 4A, 8:
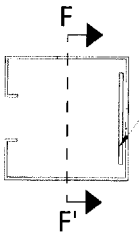
Figures 4B, 8:
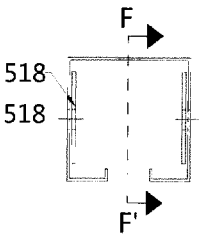
Figures 4C, 8:
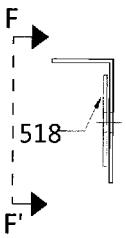
Figures 4D, 8:
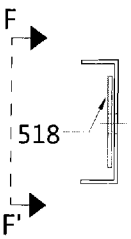
Figures 4E, 8:
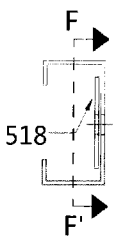
Figures 4F, 8:
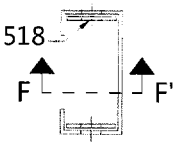
Figures 5A, 8:
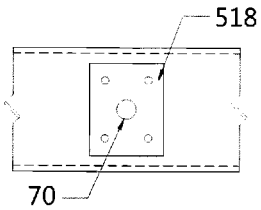
Figures 5B, 8:
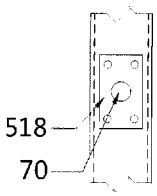

Please refer to FIG. 8-1A to FIG. 8-3A, which are diagrams of the punching groove 71 according to the present invention. As shown in FIG. 8-1A, the punching groove 71 forming on the connection hole 70 of the beam, the punching groove 71 is embedded into the enlarged connection hole 73 of the column 2. The diameter of the enlarged connection hole 73 of the column 2 is greater than the diameter of the punching grove 71. Please refer to FIG. 8-4A to FIG. 8-4F, which are sectional diagrams of the additional steel plate 518 according to the present invention. The additional steel plate 518 is attached to the connection hole 70 of the beam or the column 2. The additional steel plate 518 is fastened to the beam or the column 2 by means of a rivet, and/or a clinching join, and/or by welding. Please refer to FIG. 8-5A, which is a sectional diagram of the additional steel plate 518 along a F-F' line shown in FIG. 8-4A to FIG. 8-4E according to the present invention. Please refer to FIG. 8-5B, which is a sectional diagram of the additional steel plate 518 along a F-F' line shown in FIG. 8-4F according to the present invention.

Figures 4, 5, 6, 7, 8, 9, 9A:
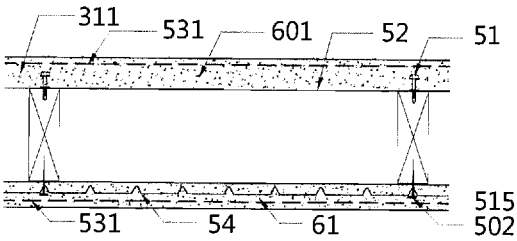
Figures 1A, 9:
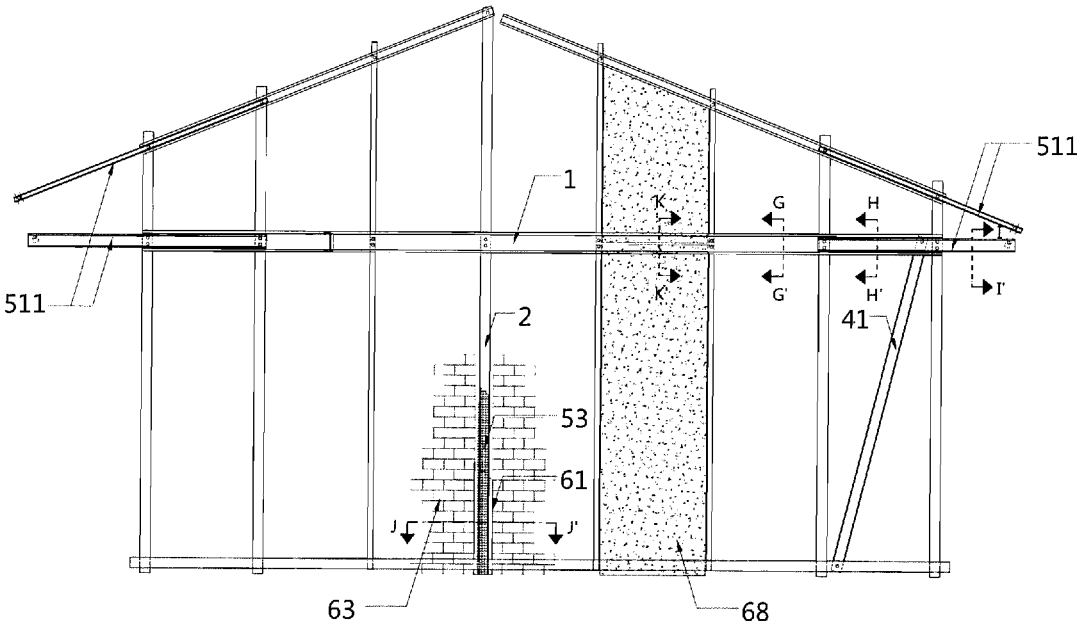
Figures 2B, 9:
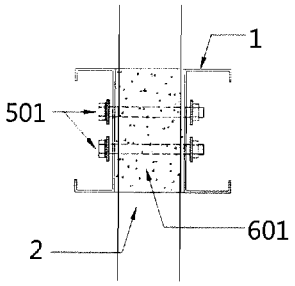
Figures 3C, 9:
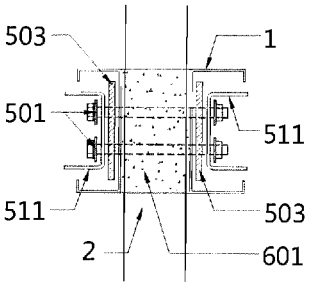
Figures 4D, 9:
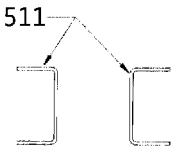
Figures 5E, 9:
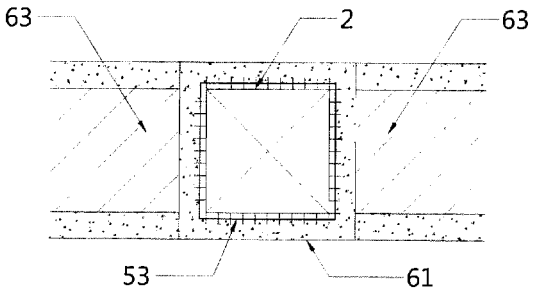
Figures 6F, 9:
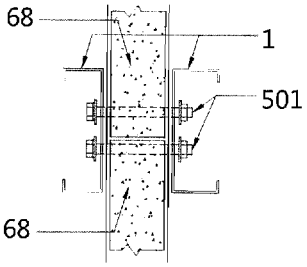

Please refer to FIG. 9-1A to FIG. 9-6F, which are diagrams of the reinforced mechanism according to the present invention. As shown in FIG. 9-2B, which is a sectional diagram of the reinforced mechanism along a G-G' line shown in FIG. 9-1A, the space between the two continuous single beams 1 is filled with the concrete and/or the cement mortar 601, so as to form the at least one reinforced mechanism. As shown in FIG. 9-3C, which is a sectional diagram of the reinforced mechanism along a H-H' line shown in FIG. 9-1A, the additional component 511 is attached on an outer side of the beam. The thermal insulating gasket 503 is arranged between the beam and the additional component 511. As shown in FIG. 9-4D, which is a sectional diagram of the reinforced mechanism along a I-I' line shown in FIG. 9-1A, the additional component 511 is attached on an outer side of the beam. As shown in FIG. 9-5E, which is a sectional diagram of the reinforced mechanism along a J-J' line shown in FIG. 9-1A, the column 2 is wrapped around by a steel mesh 53, a woven steel mesh, or an expanded steel mesh and connected to a masonry wall 63 by the cement mortar layer 61, so as to form the at least one reinforced mechanism. As shown in FIG. 9-6F, which is a sectional diagram of the reinforced mechanism along a K-K' line shown in FIG. 9-1A, a precast concrete wall slab 68 and/or a precast lightweight concrete wall slab and/or a precast hollow concrete wall slab is installed between the two continuous single beams 1.

Figures 1A, 10:
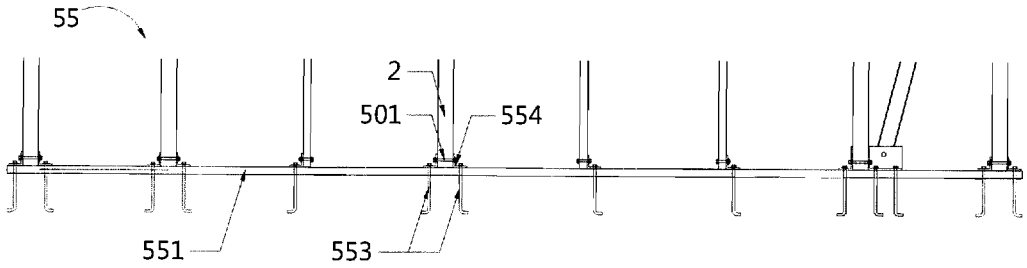
Figures 2B, 10:
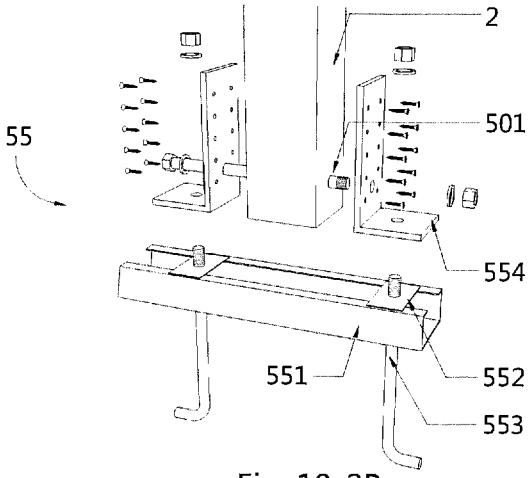
Figures 3C, 10:
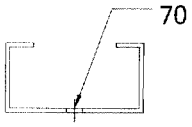
Figures 4D, 10:
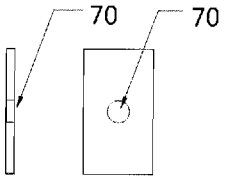
Figures 5E, 10:
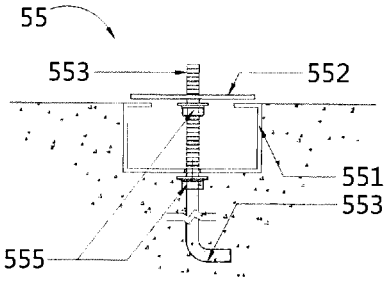

Please refer to FIG. 10-1A to FIG. 10-5E, which are diagrams of the integrally-positioned steel frame 55 according to the present invention. As shown in FIG. 10-1A and FIG. 10-2B, the integrally-positioned steel frame 55 comprises an angle connector 554, a positioning plate for bolt 552, a frame body 551, and an embedded bolt 553. The embedded bolt 553 is connected to a base of the column 2 via the angle connector 554. As shown in FIG. 10-3C, the frame body 551 is preferably formed by the C-shaped steel member with an upward opening and with a positioning hole 70. As shown in FIG. 10-4D the positioning plate for bolt 552 is with a positioning hole 70. As shown in FIG. 10-5E, the positioning plate for bolt 552 is arranged above the positioning hole 70 of the frame body 551. The frame body 551 is embedded in the foundation after the embedded bolt 553 is fixed. The anti-pulling nut 555 can be further placed below the positioning plate for bolt 552 and/or the frame body 551.

Please refer to FIG. 11-1A to FIG. 12-2B, which are diagrams of the composite wall with diaphragm effect 62 according to the present invention. The composite wall with diaphragm effect 62 encloses the structural major column 21, the minor column 22, and/or the wall reinforcing column 23, and the diagonal support 41. As shown in FIG. 11-1A, FIG. 11-2B and FIG. 11-3C, the composite wall with diaphragm effect 62 comprises a wall infill 66, a wall surfaces with diaphragm effect 621 and/or an insulating layer 65. The wall surface with diaphragm effect 621 comprises a second expanded ribbed steel mesh 56, a cement mortar layer 61, and a fastener. The second expanded ribbed steel mesh 56 comprises a V-shaped rib 561 and an expanded mesh surface. The second expanded ribbed steel mesh 56 is fixed onto the structural major column 21, the minor column 22, and/or the wall reinforcing column 23 by means of the self-tapping screw 502 the air nail 515. As shown in FIG. 11-4D, FIG. 11-5E and the FIG. 11-6F, the wall surface with diaphragm effect 621 is attached to at least one side of the structural major column 21, the minor column 22, and/or the wall reinforcing column 23. When the wall surface with diaphragm effect 621 is attached on only one side of the structural major 23, the minor column 22, and/or the wall reinforcing column 21, the lateral resistant bracing 42 is arranged at the other side of the structural major column 21, the minor column 22, and/or the wall reinforcing column 23. The lateral resistant bracing 42 is formed by a strip steel. As shown in FIG. 12-1A and FIG. 12-2E, the composite wall with diaphragm effect 62 further comprises a reinforcing member. The reinforcing member comprises a fixation gasket 517 and an anti-cracking component 531. The fixation gasket 517 is tightly attached to a grove of the V-shaped rib 561 for seating of the air nail 515. The fixation gasket 517 is preferably made of hard plastic. The anti-cracking component 531 is a fiberglass mesh or a welded steel mesh, or fiber in the cement mortar layer 61.

Please refer to FIG. 13-1A to FIG. 13-3C, which are diagrams of the expanded ribbed mesh biding wall body 64. The expanded ribbed mesh binding wall body 64 is installed between the columns 2. The expanded ribbed mesh binding wall body 64 encloses the structural major column 21, the minor column 22, and/or the wall reinforcing column 23, and the diagonal support 41. The expanded ribbed mesh binding wall body 64 comprises a wall infill 66, two second expanded ribbed steel mesh 56, and an at least one tying member 67. One of the two second expanded ribbed steel meshes 56 is fastened onto one side of the structural major column 21, the minor column 22 and/or the wall reinforcing column 23 by means of the self-tapping screw 502 or the air nail 515. The wall infill 66 is disposed between the two second expanded ribbed steel meshes 56. The second expanded ribbed steel mesh 56 comprises a V-shaped rib 561 and an expanded mesh surface. The at least one tying member 67 is a steel sire or plastic wire. The at least one tying member 67 ties the two second expanded ribbed steel meshes 56 to each other by pulling the V-shaped rib 561 of the second expanded ribbed steel meshes 56. The wall infill 66 is recycled building waste, soil, grass, concrete or lightweight concrete.

Figures 1A, 14:
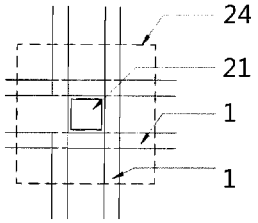
Figures 2B, 14:
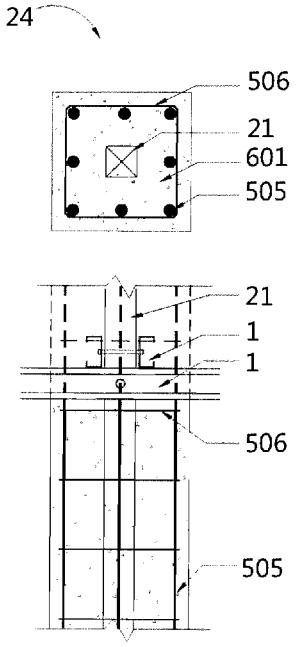
Figures 3C, 14:
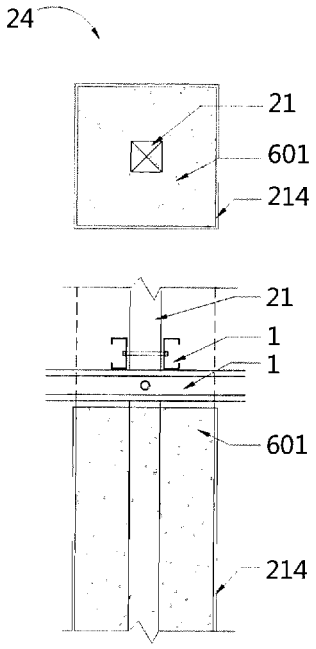

Please refer to FIG. 14-1A to FIG. 14-3C, which are diagrams of the reinforcing column 24 according to the present invention. As shown in FIG. 14-1A, the reinforcing column is at the outer periphery of the structural major column 21. As shown in FIG. 14-2B, the reinforcing column 24 comprises a reinforced concrete columns surrounding the structural major column 21. The reinforced concrete column is kept continuous or interrupted at the junction of the beam and the structural major column 21. The steel rebars 505 and stirrups 506 are arranged inside the reinforced concrete column accordingly. As shown in FIG. 14-3C, the reinforcing column 24 comprises a steel column 214 at the outer periphery of the structural major column 21. The steel column 214 is kept continuous or interrupted at the junction of the beam and the structural major column 21. The cavity between the steel column 214 and the structural major column 21 is filled with the concrete or the cement mortar 601.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A three-dimensional lightweight steel framing system comprising: continuous beams, a column (2), a wall body, a purlin (16), a lightweight composite floor system and a lateral resistant mechanism comprising a diagonal support (41) or a lateral resistant bracing (42), wherein the double continuous beam comprises two single continuous beams, the single continuous beams having identical or different section profiles the column sandwiched between the single continuous beams, the single continuous beams kept continuous at the intersection with the column; wherein the lightweight composite floor system (311) is a purlin (16), a lateral resistant bracing (42) and/or a cemented steel mesh ceiling (32), the lightweight composite floor system (311) further comprises a floor deck formed by a profiled steel sheet (52) connected to the purlin (16) by the floor connector (51) and is filled with concrete or cement mortar (601); the profiled steel sheet (52) is a corrugated profiled steel sheet or a folded profiled steel sheet, the profiled steel sheet (52) is with a 0.2-to-1.0-millimeter thickness and a 30-to-50-millimeter groove depth; the concrete or the cement mortar (601) is further installed with anti-cracking mesh or anti-cracking fiber (531); the depth of concrete or cement mortar (601) is less than 50 millimeters from the top of concrete or cement mortar (601) to the top of the profiled steel sheet (52); the floor connector 51) comprises a self-tapping screw (502), a sleeve (513) and/or a bearing gasket (514), the sleeve (513) is tightly attached to the self-tapping screw (502), the sleeve (513) is made of metal or plastic, at least one side of the sleeve (513) is expanded to form the bearing gasket (514); the purlin (16) is disposed at intervals of less than 180 centimeter; at least one pair of opposite corners of the lightweight composite floor system (311) are bounded by said lateral resistant bracing (42); said lateral resistant bracing (42) is formed by a strip steel, the strip steel is connected to the purlin (16) by the self-tapping screw (502); the cemented steel mesh ceiling (32) is connected to the purlin (16) by the self-tapping screw (502) and/or an air nail (515); the cemented steel mesh ceiling (32) comprises a first expanded ribbed steel mesh (54) covered with a cement mortar layer (61), and the cement mortar layer (61) is further reinforced with an anti-cracking mesh and/or an anti-cracking fiber (531).

2. The three-dimensional lightweight steel framing system of claim 1, the single continuous beam (1) is formed by a L-shaped steel member, a U-shaped steel member, a C-shaped steel member, a Z-shaped steel member, a plate-shaped steel member, and a slice truss;

the purlin (16) is formed by at least one of the U-shaped steel members, the C-shaped steel member, the Z-shaped steel member, and the slice truss;

the upper chord (151) and the bottom chord (152) is formed by the L-shaped steel member, and the lateral resistant diagonal support (153) is formed by the L-shaped steel member the plate-shaped steel member, or a steel tube;

the column (2) is formed by a U-shaped steel member, a C-shaped steel member, an open square-shaped steel member, a bent square-shaped steel member, and a square-shaped steel member;

the cavity of the open square-shaped steel member can be further reinforced by infilling with the concrete or cement mortar (601);

the bent square-shaped steel member is a cold rolled steel plate into square forming two 90-degree lips on both ends, and the lips at both ends are overlapped and fastened with rivets (510) at proper distances respectively;

the continuous single beam (1) is connected to the column (2) by means of a bolt (501) passing through a connection hole (70) on the web of the continuous single beam (1) and a connection hole (70) on the column (2) and fixing with nuts.

3. The three-dimensional lightweight steel framing system of claim 2, wherein the L-shaped steel member, the U-shaped steel member, the C-shaped steel member, the Z-shaped steel member and the open square-shaped steel member are provided with curled lips; and an upper flange and a bottom flange of the U-shaped steel member, an upper flange and a bottom flange of the C-shaped steel member, or an upper flange and a bottom flange of the Z-shaped steel member have an identical width or different widths, the L-shaped steel member, the U-shaped steel member, the C-shaped steel member, the Z-shaped steel member, the open square-shaped steel member, the bent square-shaped steel member and the plate-shaped steel member are constructed from cold rolled galvanized steel reel.

4. The three-dimensional lightweight steel framing system of claim 1, wherein the single continuous beam (1) includes at least one overlapped connection or at least one beam connector (512).

* * * * *